US007859479B2

(12) United States Patent
Legare et al.

(10) Patent No.: US 7,859,479 B2
(45) Date of Patent: Dec. 28, 2010

(54) ANTENNA FOR COMPACT SATELLITE TERMINAL

(75) Inventors: David J. Legare, Ava, NY (US); David M. Hummel, Remsen, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 346 days.

(21) Appl. No.: 12/231,420

(22) Filed: Aug. 26, 2008

(65) Prior Publication Data

US 2009/0243955 A1 Oct. 1, 2009

Related U.S. Application Data

(60) Provisional application No. 61/123,565, filed on Mar. 25, 2008.

(51) Int. Cl.
*H01Q 15/20* (2006.01)

(52) U.S. Cl. ..... 343/882; 343/915; 343/916; 343/880; 343/881

(58) Field of Classification Search ..... 343/915, 343/916, 880, 881
See application file for complete search history.

(56) References Cited

U.S. PATENT DOCUMENTS

| | | | | |
|---|---|---|---|---|
| 4,893,132 | A * | 1/1990 | Habibi | 343/912 |
| 6,677,911 | B2 * | 1/2004 | Moheb | 343/786 |
| 7,423,609 | B2 * | 9/2008 | Sankela et al. | 343/915 |

* cited by examiner

*Primary Examiner*—Douglas W Owens
*Assistant Examiner*—Dieu Hien T Duong
(74) *Attorney, Agent, or Firm*—Joseph A. Mancini

(57) ABSTRACT

An antenna for a compact satellite terminal. Antenna is a rigid parabolic structure of metal matrix composite capable of disassembly into segments affording a high degree of portability such as for man-packable satellite terminals and the like. A shallow feed horn assembly is joined to an orthomode transducer by a common hub, the hub also serving as the attachment point for a plurality of antenna segments, where a quick release means joins the segments to the hub. The feed horn, hub, orthomode transducer and antenna segments are designed for extremely compact stowability in a variety of applications.

15 Claims, 8 Drawing Sheets

ANTENNA FOR COMPACT SATELLITE TERMINAL

PRIORITY CLAIM UNDER 35 U.S.C. §119(e)

This patent application claims the priority benefit of the filing date of provisional application Ser. No. 61/123,565, having been filed in the United States Patent and Trademark Office on Mar. 25, 2008 and now incorporated by reference herein.

STATEMENT OF GOVERNMENT INTEREST

The invention described herein may be manufactured and used by or for the Government of the United States of America for governmental purposes without the payment of any royalty thereon.

BACKGROUND OF THE INVENTION

1. Technical Field of the Invention

This invention relates generally to the field of ground-based satellite communications equipment. More specifically the present invention relates to lightweight, portable, ground satellite communications terminals and stowable antenna structures to be used therewith.

2. Background

Communication by satellite is essential in remote locations of the world where terrestrial communications networks do not exist. Moreover, when moving about remote locations, satellite communications equipment must be mobile. Smaller, lighter satellite communications equipment affords greater mobility. Satellite communications in the higher frequency bands such as X, K and Ku require a minimum transmit and receive directed gain that is much higher than the non-directional gain of handheld satellite transceivers in the L- band. Therefore, to achieve the necessary directional gain, mobile satellite transceivers in the X, K and Ku bands require directional antenna systems generally comprising parabolically shaped reflecting surfaces.

Generally speaking, while electronics have become smaller and more efficient over the years, minimum antenna size remains bounded by the physics of electromagnetic radiation and the need for larger physical antenna size (i.e., aperture) to achieve a higher directed gain. It is not uncommon for antenna systems to comprise the least transportable component of modern portable satellite transceivers.

Efforts have been made to achieve a higher degree of transportability of satellite communications antenna systems. Early efforts employed umbrella-like unfolding antennas comprising Mylar material stretched over lightweight metallic frameworks. Other efforts incorporated parabolic-shaped recesses into the satellite terminal enclosures themselves. Many others efforts involved assembling sections of flat or semi-flat panels into mosaics to achieve a larger reflecting surface. While some of these designs may indeed increase directed gain at low satellite frequencies such as in the L-band, they provide inherently unacceptable directive gain at X, K and Ku bands. The design constraint which prior attempts face at higher frequencies is their inability to provide true parabolic reflecting surfaces necessary for narrow, focused (i.e., directed) beamwidths required not only for gain, but also for discriminating among adjacent geostationary satellites position in equatorial orbits.

3. The Prior Art

U.S. Patent Application Publication 2005/0212715 A1 to Saunders (hereinafter, Saunders) attempts to overcome the effects of rain fade by increasing the physical reflecting surface of a fixed antenna reflector by adding extensions around its periphery. The invention in Saunders, however, provides no means for compacting the fixed portion of the antenna reflector. Therefore, the invention in Saunders would not solve portability issues in transportable satellite communications terminals.

U.S. Pat. No. 5,019,833 to Nonaka et al discloses a parabolic antenna for television signal reception that affords a degree of transportability by virtue of having its means for positioning incorporated into the rear of the parabolic antenna where both comprise a common assembly joined by hinges. The problem not solved by Nonaka is reducing the transportable size of the parabolic antenna reflector.

U.S. Pat. No. 4,862,190 to Palmer et al discloses a deployable parabolic dish antenna where alternating sections of triangular and rectangular reflector surfaces are connected about the periphery of a stationary main reflector surface by hinges. Upon deployment, the triangular and rectangular sections rotate outward to form a larger resultant parabolic reflecting surface centered about the main reflector. The problem with this approach is that the triangular and rectangular sections, when not deployed, are positioned perpendicularly to the main reflector, resulting in the overall displaced volume of the antenna structure to be as great when stowed as when deployed.

U.S. Pat. No. 3,618,101 to Emde et al discloses a collapsible parabolic antenna for use on-board satellites. The antenna in Emde employs at least one fixed semicircular segment and at least one movable semicircular segment which, when rotated into position, provide a 360 degree reflecting surface. Because this antenna is designed for automatic deployment, the movable segments remain connected to the primary axis of the antenna structure at all times. The result, therefore, is that the stowed volume of the antenna is less, but not significantly less, than the deployed volume of the antenna.

U.S. Pat. No. 5,554,999 to Gupta et al discloses a collapsible flat antenna that provides phasing so as to simulate the antenna radiation characteristics of a parabolic dish reflector antenna. Phasing is accomplished by a plurality of reactive elements responsive to different frequencies within the antenna's bandwidth. The antenna disclosed in Gupta is intended to be a flexible structure allowing stowage by collapsible folding. One limitation of this approach is that phased antennas yield optimum radiation patterns at the specific frequency their reactive elements are designed for, whereas parabolic reflecting antennas exhibit optimum radiation patterns across frequency bands. Another limitation of a flexible structure is the difficulty in physically supporting it and maintaining its orientation.

U.S. Patent Application Publication 2004/0196207 A1 to Schefter et al discloses a collapsible antenna for portable satellite terminals which employs a reflector assembly comprising a plurality of panels which may be connected to each other for deployment and disconnected for stowage. Connection of each panel to the other is by means of quarter turn quick release cam nuts. A separate boom arm is used to mount the feed assembly at a focused distance from the reflector assembly. Schefter discloses that the reflector is comprised of four (4) panels. However, the antenna design suffers from large overall size because, it is not a true parabolic structure and because it is a truncated structure, the feed focus is necessarily deep, as opposed to shallow feed focuses with non-truncated parabolic structures.

U.S. Pat. No. 5,061,945 to Hull et al discloses a lightweight, collapsible satellite communications dish antenna having a plurality of identical pre-shaped sectors joined at their apex which can be stowed by rotating all of the sectors about their apex so as to result in their lying substantially atop each other. The invention in Hull inherently requires that the sectors be made of a highly flexible material so as to be capable of being drawn into a curvature shape upon deployment while also capable of returning to a flat shape for stowage. Hull does not disclose any cognizable means for mounting a signal feed means at the dish focus.

What the prior art fails to provide and what is needed, therefore, is an antenna which (1.) is extremely compactable when stowed and (2.) still retains true parabolic reflector properties when deployed.

OBJECTS AND SUMMARY OF THE INVENTION

The present invention provides an apparatus for terrestrial-based satellite communications which provides improved transportability over the prior art.

It is therefore an object of the present invention to provide an antenna for a compact satellite terminal which exhibits characteristic parabolic radiation patterns at all angles.

It is a further object of the present invention to provide an antenna for a compact satellite terminal which utilizes a shallow, compact feed to reduce both its deployed and stowed volume.

It is still a further object of the present invention to provide an antenna for a compact satellite terminal which requires no tools for assembly, disassembly, and to change polarization.

It is yet still a further object of the present invention to provide an antenna meeting all of the above objectives yet being adaptable to a variety of satellite terminals operating at a variety of different frequencies.

An additional object of the present invention is to overcome a lack in the prior art of portable satellite antenna designs, some of which are compact but offer neither true parabolic characteristics nor ruggedness.

Briefly stated, the present invention achieves these and other objects by providing an antenna for a compact satellite terminal. The antenna is a rigid parabolic structure of metal matrix composite capable of disassembly into segments affording a high degree of portability such as for man-packable satellite terminals and the like. A shallow feed horn assembly is joined to an orthomode transducer by a common hub, the hub also serving as the attachment point for a plurality of antenna segments, where a quick release means joins the segments to the hub. The feed horn, hub, orthomode transducer and antenna segments are designed for extremely compact stowability in a variety of applications.

In a fundamental embodiment of the present invention, an antenna for a compact satellite terminal has a hub with a input side, an output side, and a plurality of slots equidistantly located on the periphery of the hub where a plurality of antenna segments being equal in number to said plurality of the slots are removably attached into and where a feed horn and an orthomode transducer are removably attached to the input and the output sides of the hub.

Still according to a fundamental embodiment of the present invention, an antenna for a compact satellite terminal, where each of the plurality of antenna segments are removably attached into each of the like plurality of said slots by means of a tab, one end of which forms an anchor being fastened to each antenna segment and the other end of which forms a tenon-like projection and also by detents located on at least one surface of each tenon-like projection into which spring actuated balls located inside at least one surface of said slot of said hub captively mate to secure each tab into its respective slot.

Still yet, according to a fundamental embodiment of the present invention, an antenna for a compact satellite terminal, where each of the plurality of antenna segments are conductive composite structures fabricated from a nickel nanostrand metal matrix composite material.

The above and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
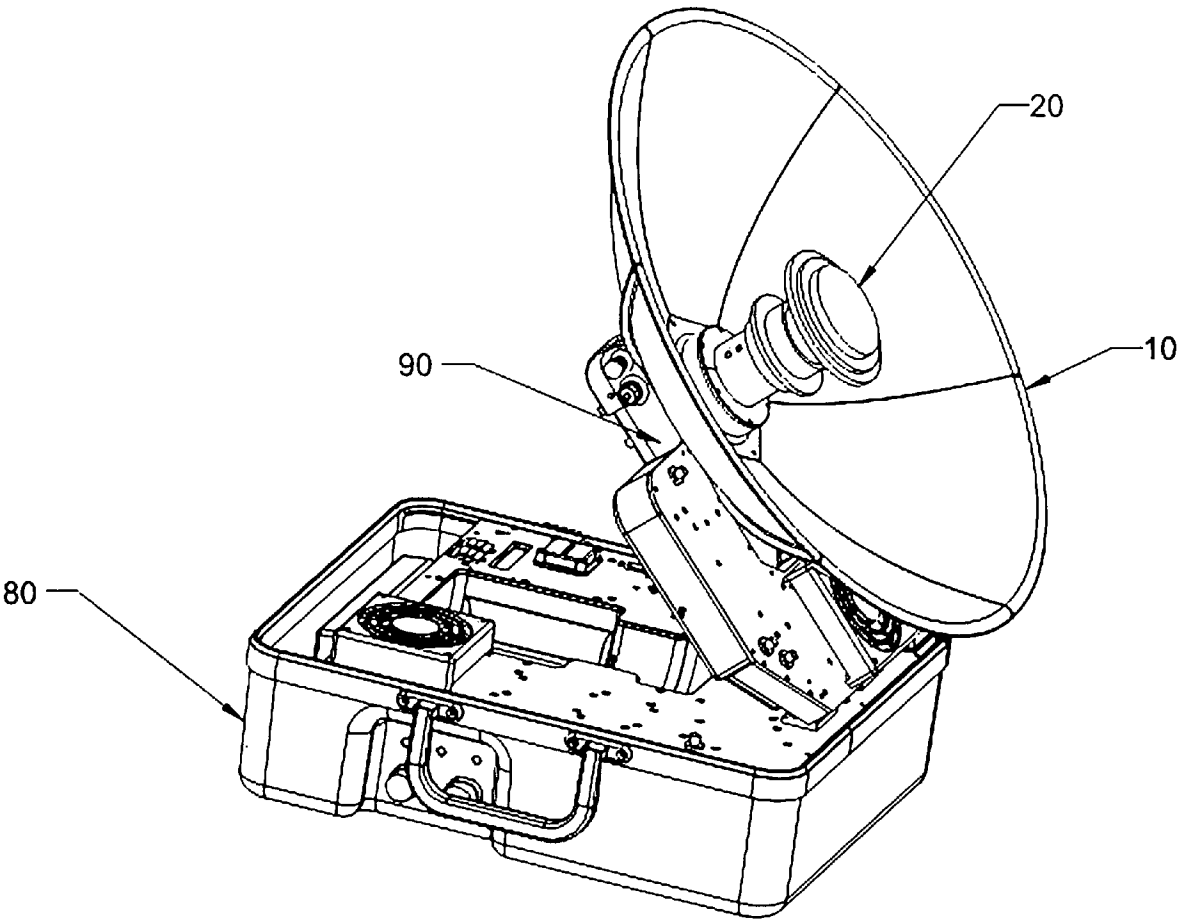
FIG. 1 depicts the present invention as part of a very compact transportable satellite terminal.

The present invention describes an antenna design that collapses into an optimally-dense package for stowage and carrying, and which can be easily set up and taken down. Such an antenna would find application in very compact and highly portable satellite communications terminals. The invention incorporates a number of unique features which collectively result in a very lightweight and compact system which can be configured to support full-duplex communications over satellites in earth orbit. These satellites are in most cases envisioned to be in geosynchronous orbit, with the satellite terminal antenna in a fixed orientation during the communications session. However, transportable terminal designs should be readily modifiable to provide for active tracking of the antenna for use on a moving platform, or with non geosynchronous satellites. Those skilled in the art would appreciate a practical implementation of the invention as readily applicable to a backpack transportable system weighing at 20 lbs or less and having rough stowed package dimensions of about one cubic foot or less (i.e., 12 inches by 12 inches by 12 inches). Such a terminal is depicted in FIG. 1. Typical operating frequency bands would be around 7 Ghz to 40 Ghz (e.g. X-band, Ku band, Ka band). The present invention is by no means limited to these frequency bands, however. It should be noted that the present invention is entirely scalable so as to provide whatever aperture gain is required at any frequency.

Still referring to FIG. 1, the present invention provides compact, transportable terminal aperture gain by a novel parabolic antenna having a single reflecting surface 10 (no secondary reflector) to a shallow feed 20 positioned at the reflector focus. For supporting significant full-duplex data rates of around 512 Kbs to 2 Mbs, and to maintain reasonably narrow beamwidths to minimize potential intersatellite interference, aperture sizes of 18 to 30 inches in diameter would be required. However, apertures of any size whatsoever are within the scope of this invention.

Figure 2:
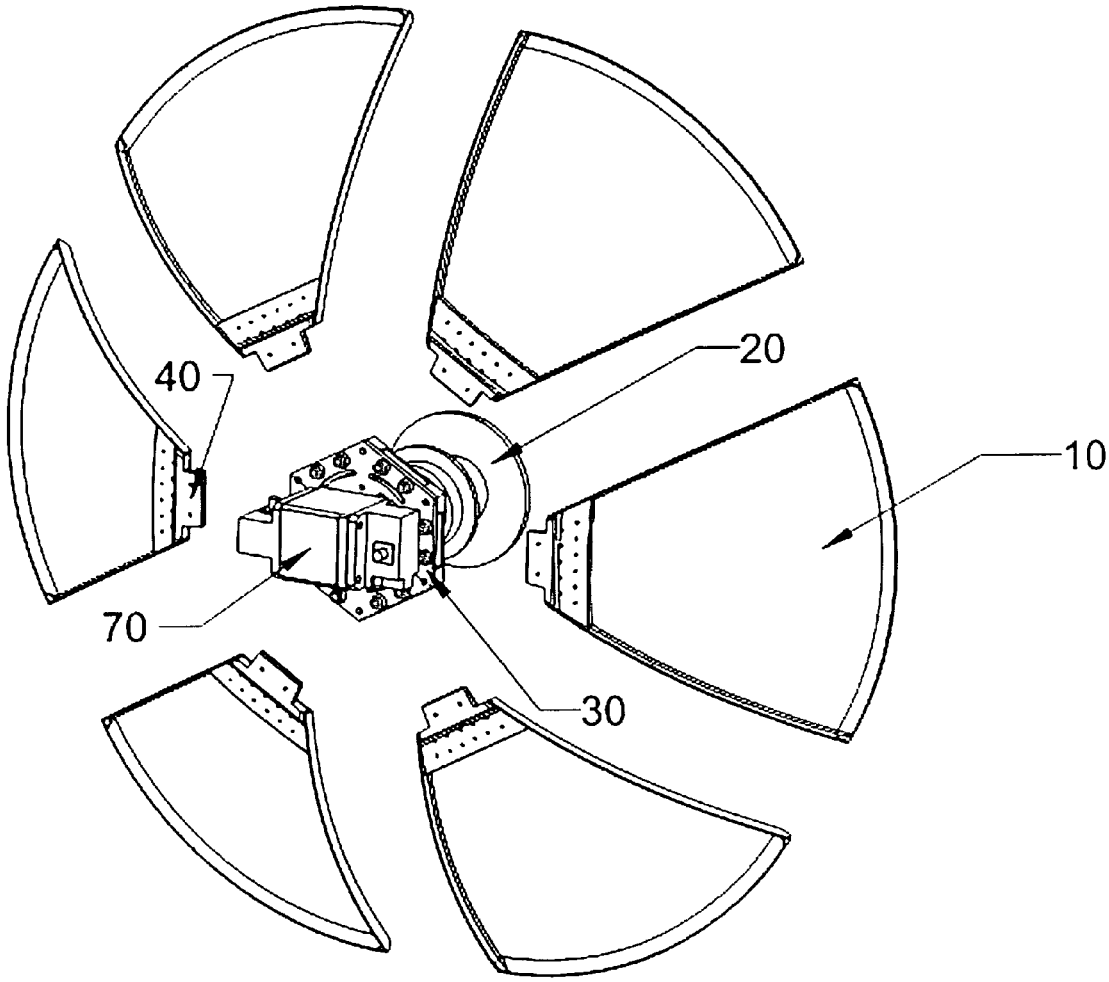
FIG. 2 depicts an exploded view of the present invention.

Referring to FIG. 2, because a single piece parabolic reflector would be too large to conveniently transport, the present invention provides a means to assemble a parabolic reflector from a plurality of trapezoidal shaped segments which plug into a hub with the antenna feed at its center. One skilled in the art would note that while a smaller or larger number of segments could be employed without limiting the utility if the invention, six segments have been chosen for a particular embodiment of the invention intended to fit within a terminal package for stowage and transport having an approximate 12 inch by 12 inch footprint. An exploded view shows the segmentation of the antenna reflector 10 with feed 20 in center, antenna hub block 30, composite antenna segments 10 with integral end tabs 40 for attachment to the hub 30.

Figure 3:
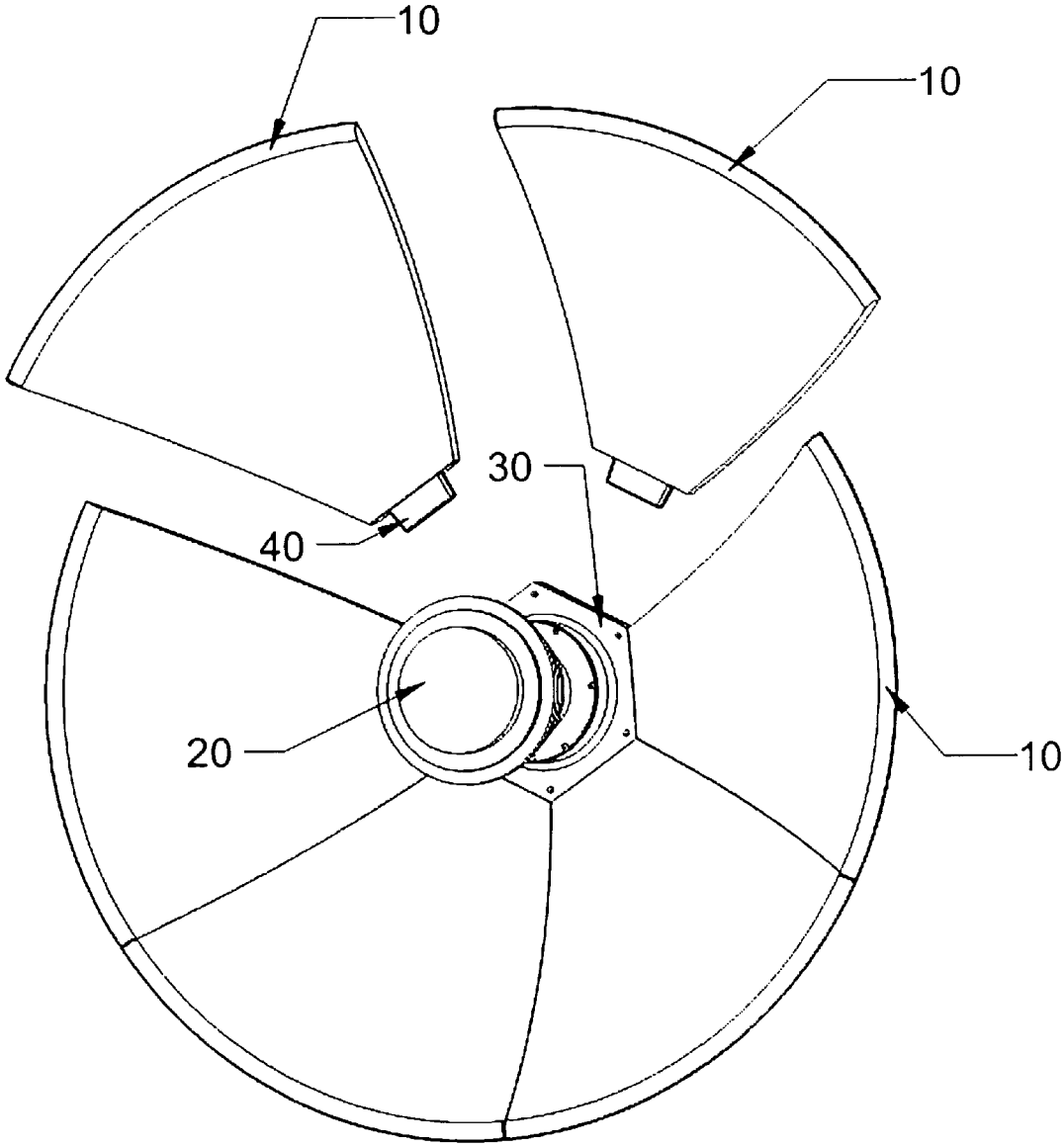
FIG. 3 depicts a view of how the present invention is assembled.

Referring to FIG. 3, depicting a partially assembled view of the antenna assembly with feed 30 in center. The reflector segments 10 are preferably made from a single shell (about 0.050" thick) of a high electrical conductivity graphite composite material which has an attached (or molded-in) end connector tab 40 by which it is pressed into the hub. Suitable composite materials for the reflector segments 10 include metal matrix composites such as but not limited to nickel nanostrand. The tab receiver slot (not shown, see 50, FIG. 4) in the hub 30 preferably incorporates a small spring plunger (not shown, see 60, FIG. 5) that provides for a snap fit to hold the tab in place, while allowing it to be easily pulled free with a light tug. Alternatively, the spring plunger may be located within the hub slot and a corresponding detent located on the tab. Additionally, the tab may be tapered and or lengthened in more than one dimension to mate with a similar taper and length in the hub slot (not shown, see 50, FIG. 4) for greater retention. Other means for retention of the tab into the slot are clearly within the scope of this invention.

Figure 4:
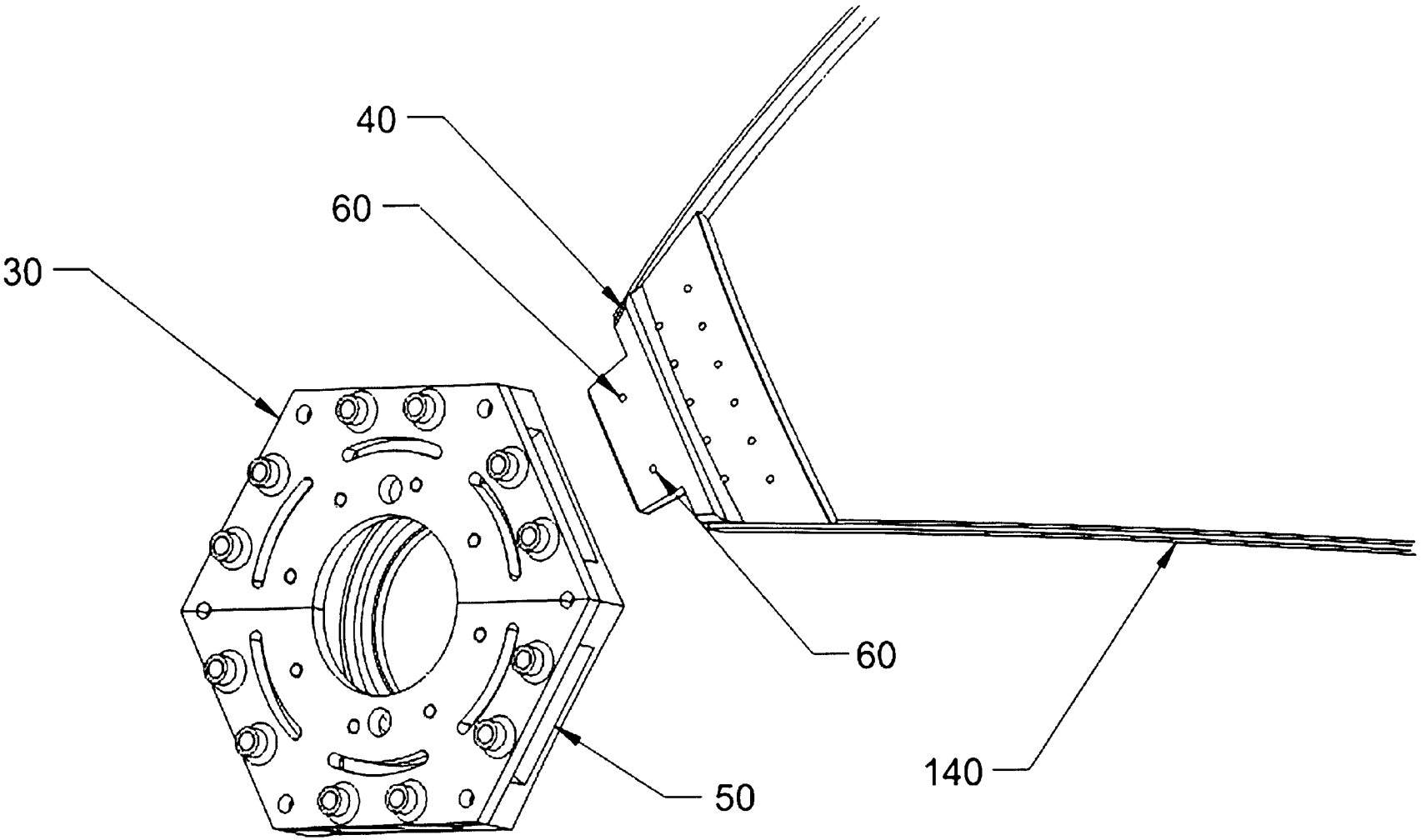
FIG. 4 depicts a view of how the individual arts of the present invention assemble.

Referring to FIG. 4, a close-up view of antenna hub and pedal shows how tab 40 at end of petal interlocks with slot 50 in hub 30. Note detent (not shown) in tab 40 for spring-loaded pin 60 inside hub 30 slot 50. Also note that hub 30 slots 50 and tabs 40 are slightly tapered on three sides for ease of assembly. Segments 10 may also incorporate a spline 140 along their edges that would interlock with corresponding grooves or slots (not shown) on the edges of adjacent segments for adding rigidity to the antenna when assembled. Other modes of interlocking the segments to accomplish the same certainly exist. In an embodiment of the present invention, the metal matrix composite composition of the segments 10 provides sufficient rigidity without the need for splines 140.

Figure 5:
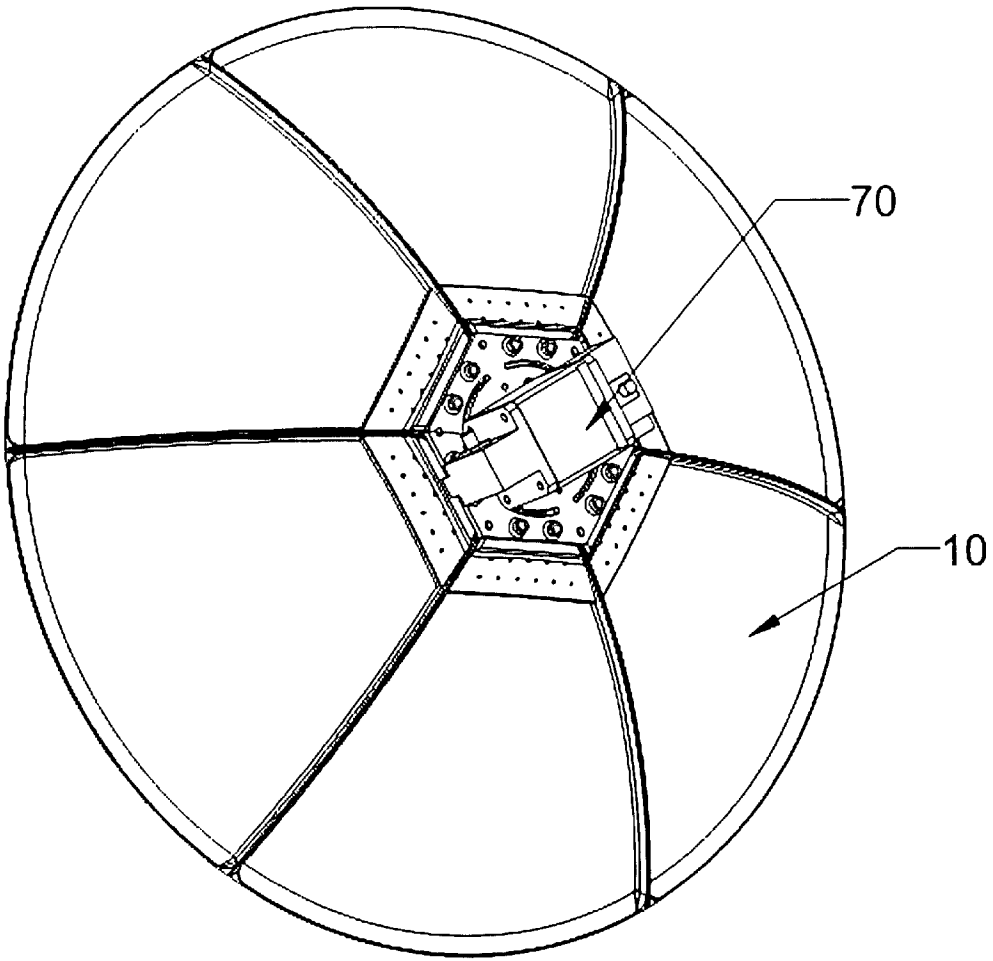
FIG. 5 depicts a rear view of the assembled present invention.

Referring to FIG. 5 shows a rear view of the segmented antenna 10 of the present invention as fully assembled. The orthomode transducer (hereinafter OMT) 70 is visible from this rear view.

Figure 6:
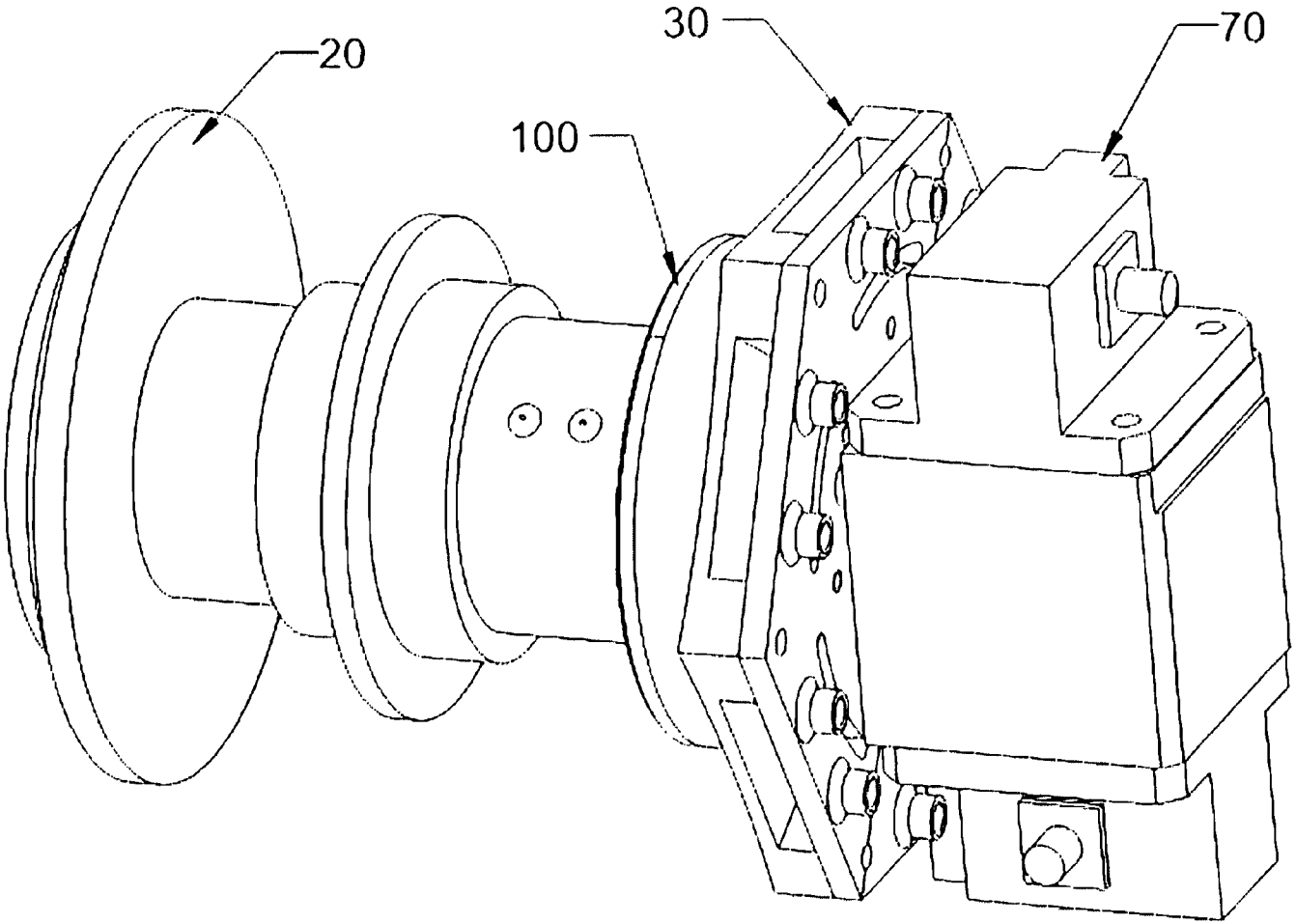
FIG. 6 depicts a view of the hub, feed and OMT of assembled present invention.

Referring to FIG. 6 shows the antenna hub 30 relationship to the feed horn 20 OMT 70 as an assembly. Signals feed into and out of the OMT 70 into and out of a terminal electronics box (not shown, see 80, FIGS. 1 and 8). The feed horn 20 and the OMT 70 rotate radially with respect to each other and are held together by the antenna hub 30.

Figure 7:
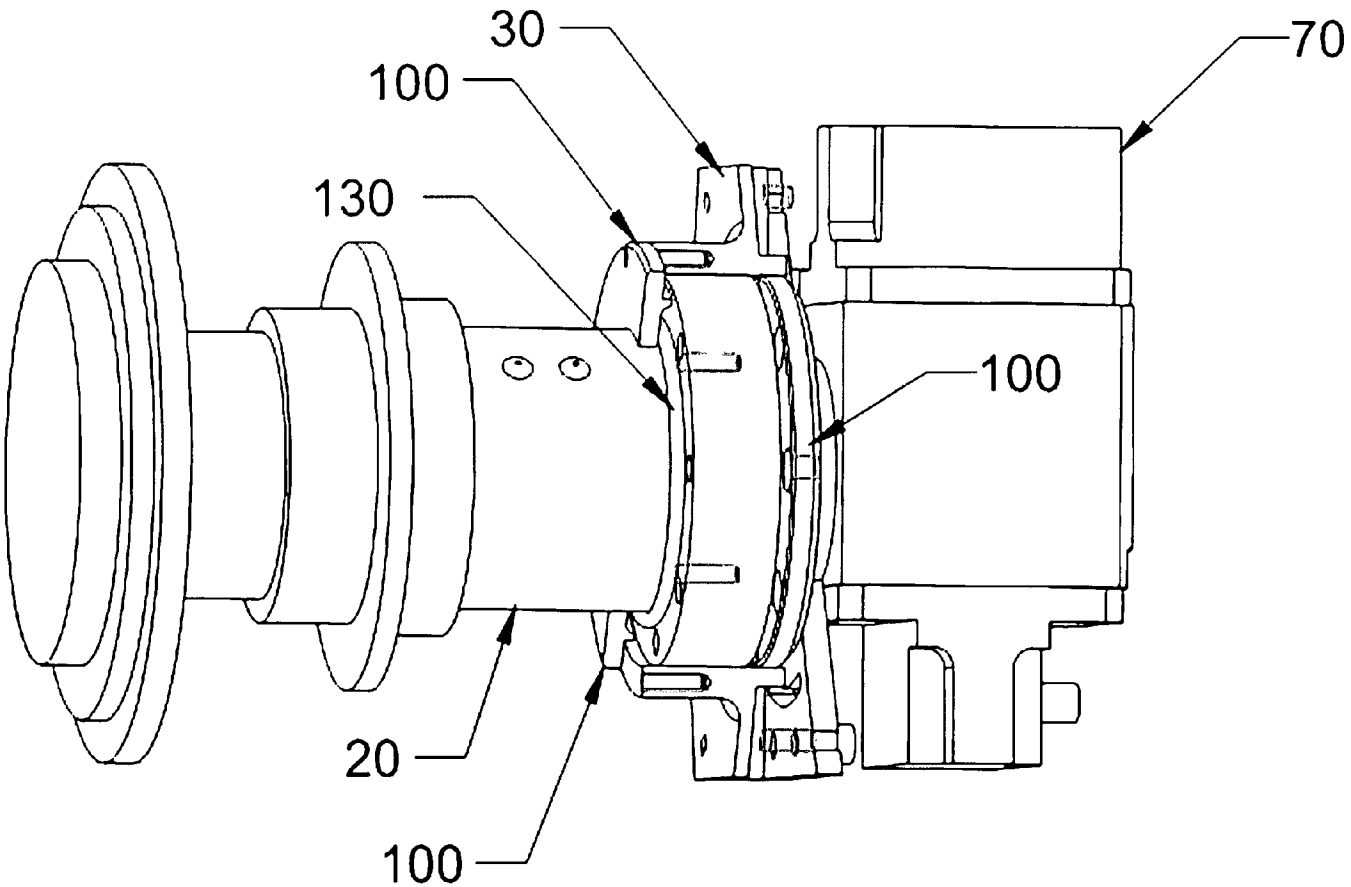
FIG. 7 depicts a cutaway view of how the hub mechanically captivates the feed and the OMT of present invention.

FIG. 7 depicts the mechanical relationship between the feed horn 20, antenna hub 30, and OMT 70. In the cutaway view the feed assembly shows how hub 30 with attached cap 100 captivates flanges on the ends of both the feed horn 20 and OMT 70. In this fashion, the feed horn 20, hub 30 and OMT 70 are joined as an assembly. The OMT 70 is attached to elevation support arms (not shown, see 90, FIG. 1).

Still referring to FIG. 7, the antenna feed comprises two sections, an OMT 70 portion behind the reflector 10, and the feed horn 20 section at the front surface of the reflector 10. The feed horn 20 can be hand rotated relative to the OMT 70, which is fixed to the hub 30, for the purpose of changing polarization. Detents (not shown) on the OMT 70 mating surface combined with a small spring plunger (not shown) on the feed horn 20 mating surface serve to index the position of each polarization (eg. LHCP, RHCP). The feed horn side can thus be rotated along the radial axis (about + or −90 degrees) to change polarization. Circular polarizations are also with the scope of the present invention. Additionally, in one embodiment of the invention, an internal pin (not shown) located in a 90 degree arced groove or slot (not shown) is employed to index the polarization by limiting the rotation of the feed horn 20 relative to the OMT 70 to 90 degrees. A slight amount of friction between the feed horn 20 and the cap 100 eliminates slop and backlash and is provided by an elastomeric ring functioning as a bearing surface 130.

Figure 8:
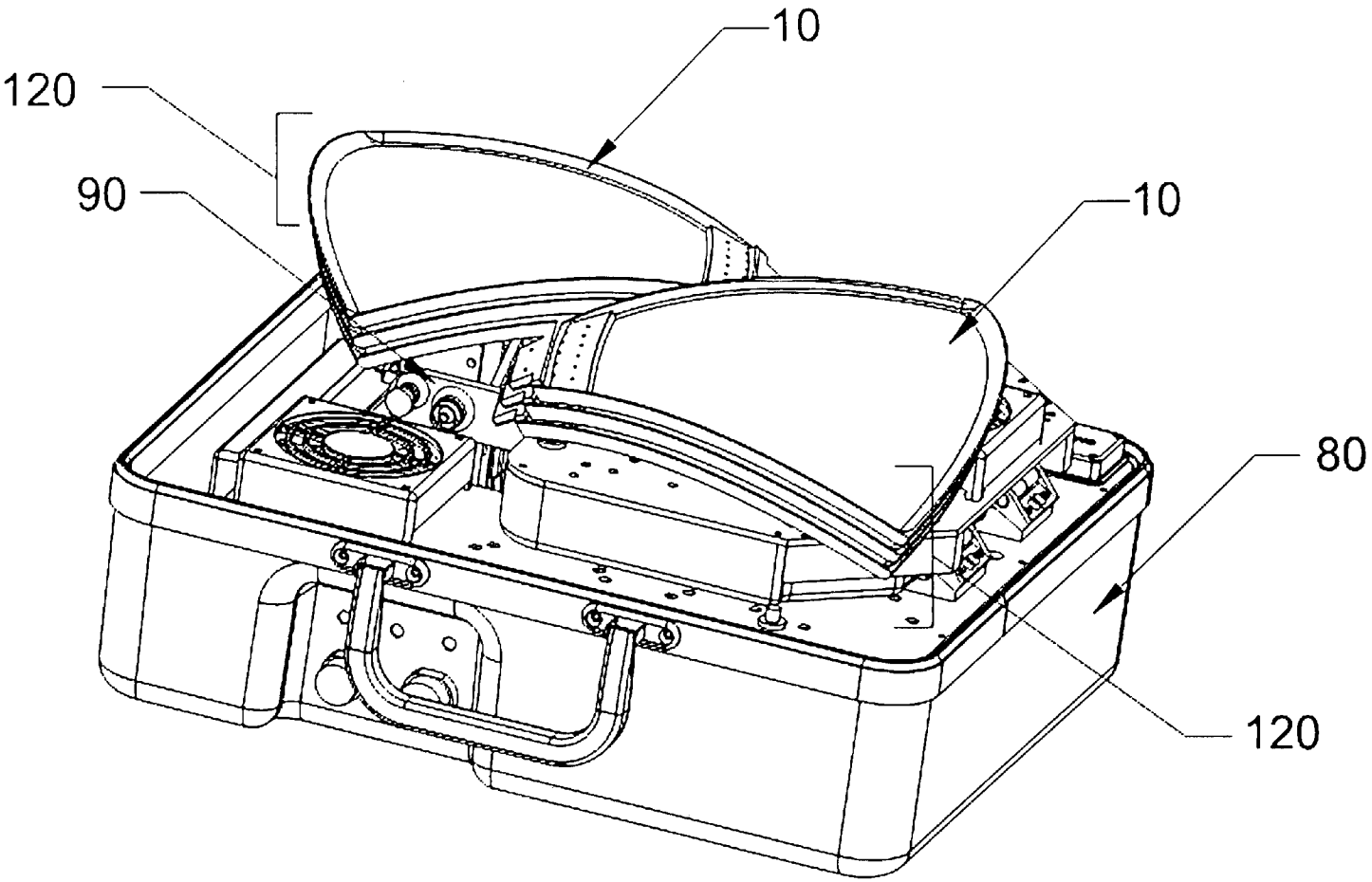
FIG. 8 depicts a view of the present invention in a stowed configuration.

Referring to FIG. 8, the antenna of the present invention is depicted with an exemplary compact satellite terminal in the stowed position. The feed horn, hub, and OMT assembly (hidden from view), with the antenna reflector segments 10 detached, rotates backward into a position in which the feed horn is aligned parallel with the feed support arms. From here the elevation arms 90 can be lowered into a position of zero degrees with the horizon with the feed flat with the top of the box. The antenna reflector segments 10 are then stacked 120 on top of the feed with the curved edge over the protruding edge of the hub for maximum storage compactness. A cover typically would snap over the top of the box 80 for transport.

To deploy an exemplary compact satellite terminal incorporating the antenna of the present invention, the elevation arms 90 are raised to an angle where the feed and hub assembly can be rotated (around feed pivot point) into a position perpendicular to the elevation arms. A spring-loaded pin is employed to hold the feed and hub assembly in this position. The antenna reflector segments 10 are then snapped into place and the deployed configuration take the exemplary form of that depicted in FIG. 1. The pointing and signal acquisition process can typically now begin by first setting the elevation angle.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An antenna for a compact satellite terminal, comprising:

a hub, said hub having a input side;

an output side; and a plurality of slots equidistantly located on the periphery of said hub;

a feed horn;

an orthomode transducer;

a plurality of antenna segments being equal in number to said plurality of said slots;

a first means to removably attach said feed horn to said input side of said hub;

a second means to removably attach said orthomode transducer to said output side of said hub; and a third means to removably attach each of said plurality of antenna segments into each of said plurality of said slots.

2. Said antenna segments of claim 1, each further comprising a means for interlocking with adjacent said antenna segments, said means for interlocking comprising a spline located on the first major side of each of said plurality of antenna segments and a groove located on the second major side of each of said plurality of antenna segments, wherein said spline and said groove are caused to interlock when adjacent said plurality of antenna segments are removably attached into adjacent said plurality of slots so as to secure adjacent said antenna segments into mutual alignment.

3. Said third means to removably attach each of said plurality of antenna segments into each of said plurality of said slots of claim 1, further comprising:

a tab, one end of which forms an anchor being fastened to said antenna segment and the other end of which forms a tenon-like projection;

at least one detent located on at least one surface of said tenon-like projection;

at least one spring actuated ball located inside at least one surface of said slot of said hub;

wherein said slot and said tenon-like projection comprise a substantially mortise and tenon-like mechanical fit; and wherein said at least one detent captivates said at least one spring actuated ball when said tenon-like projection is inserted into said slot so as to removably attach each of said plurality of said antenna segments to said hub.

4. Said first means to removably attach said feed horn to said input side of said hub of claim 1, further comprising:

a first cap, said first cap having means for removably fastening to said hub; and a flanged surface on said feed horn;

wherein said first cap, when removably fastened to said hub, captivates said flanged surface of said feed horn between said first cap and said hub so as to removably attach to said feed horn to said hub.

5. Said second means to removably attach said orthomode transducer attached to said output side of said hub of claim 1, further comprising:

a second cap, said second cap having means for removably fastening to said hub; and a flanged surface on said orthomode transducer;

wherein said second cap, when removably fastened to said hub, captivates said flanged surface of said orthomode transducer between said second cap and said hub so as to removably attach to said orthomode transducer to said hub.

6. Said plurality of antenna segments of claim 1, each being substantially comprised of metal matrix composite.

7. Said metal matrix composite of claim 6 being substantially nickel nanostrand material.

8. Said flanged surface of said feed horn of claim 4, further comprising a bearing surface proximate to said first cap so as to provide a means to rotate said feed horn relative to said hub.

9. Said means to rotate said feed horn of claim 8 further providing means for changing the polarization of said antenna.

10. Said bearing surface of said of claim 8 comprises an elastomer.

11. Said means for changing the polarization of said antenna of claim 9 further comprising a rotation limiter, said rotation limiter providing no greater than 90 degrees relative rotation between said feed horn and said orthomode transducer.

12. Said rotation limiter of claim 11 further comprising a pin disposed in a slot, said slot having endpoints spaced 90 degrees apart along an arc, wherein said slot endpoints engage said pin to limit said rotation.

13. Said antenna of claim 1, further comprising a pair of elevation support arms pivotally connected to said orthomode transducer so as to allow said hub, said feed horn, and said orthomode transducer to alternately rotate frontward and elevate to a deployed position and rotate rearward and lower to a stowed position.

14. Said pair of elevation arms of claim 13, further comprising means to limit said forward rotation of said hub, said feed horn, and said orthomode transducer to an orientation that is perpendicular to said elevation arms.

15. Said pair of elevation arms of claim 13, further comprising means to limit said rearward rotation of said hub, said feed horn, and said orthomode transducer to an orientation that is parallel to said elevation arms.

* * * * *